US006523867B1

(12) United States Patent
Yeh

(10) Patent No.: US 6,523,867 B1
(45) Date of Patent: Feb. 25, 2003

(54) AUTOMATIC CLASPING DEVICE FOR A CABINET DOOR

(76) Inventor: Shun-Hsiang Yeh, No. 78-2, Tsai Gong Ken, Dian Zu Chun, San Zh Hsiang, Taipei Hsien (TW)

( * ) Notice: Subject to any disclaimer, the term of this patent is extended or adjusted under 35 U.S.C. 154(b) by 0 days.

(21) Appl. No.: 10/073,166

(22) Filed: Feb. 13, 2002

(51) Int. Cl.[7] ..... E05C 5/00
(52) U.S. Cl. ..... 292/63
(58) Field of Search ..... 292/124, 111, 292/37, 8, 27, 140, 145, 146

(56) References Cited

U.S. PATENT DOCUMENTS 917,969 A * 4/1909 Shinn ..... 292/109
983,647 A * 2/1911 Romines ..... 292/111
1,180,619 A * 4/1916 Strelcsik ..... 292/124
1,601,359 A * 9/1926 Harrington ..... 70/100
5,401,067 A * 3/1995 Kurosaki et al. ..... 292/63
5,865,480 A * 2/1999 Bain, Jr. et al. ..... 292/67

* cited by examiner

*Primary Examiner*—Robert J. Sandy
*Assistant Examiner*—Ruth C. Rodriguez
(74) *Attorney, Agent, or Firm*—Dennison, Schultz & Dougherty

(57) ABSTRACT

An automatic clasping device for a cabinet door includes a clasp base secured on a cabinet body and a hook fixed on a cabinet door. A clasping member is fitted in a slide groove of the clasp base. The clasping member is formed with an upper curved surface and a booking surface pressed by a spring for pulling the cabinet door. When the cabinet door is closed, the end of the hook touches the upper curved surface and lifts up the front end of the clasping member to let a position-limiting rod disengaged from the stop wall. Meanwhile, the hooking surface clasps the hook and pulls the door to be closed completely by a spring. When the door is opened, the clasping member will be pulled outward to let the position limiting rod slide rest against the stop wall, and the hooking surface is separated from the hook.

2 Claims, 5 Drawing Sheets

AUTOMATIC CLASPING DEVICE FOR A CABINET DOOR

BACKGROUND OF THE INVENTION

This invention relates to an automatic clasping device for a cabinet door, particularly to one capable to make a cabinet door fully closed, and easy and convenient in handling.

Nowadays, various cabinets, such as cupboards, wardrobes, filing cabinets or the like, are commonly used for storing different articles in families and in offices. And the user of these cabinets is mostly concerned about how to keep the cabinet door closed completely, not only for aesthetic appearance but for safety as well.

A conventional way of closing up a cabinet door is to have the cabinet door provided with a bolt or have a resilience recovering device fitted with the hinge of a cabinet door. Another conventional way for closing up a cabinet door is to have a fixing clasp provided between a cabinet door and a cabinet body, as shown in FIG. 1. Such device includes an elongate cone-shaped insert pin 1 with a bottom plate 2 secured on the door 3, and a clamping member 4 fixed at a corresponding position of the cabinet body 5. The clamping member 4 has two resilient clamping wheels 6 facing each other and fitted in its slide groove 7 to slide therein, with the resilient clamping wheels 6 normally contacting closely with each other by the resilient force of a spring. When the cabinet door is to be closed, just apply a certain force to the door to let the front-coned end of the insert pin 1 inserted in between the two resilient clamping wheels 6 and clamped therein, thus keeping the door 3 closed. On the contrary, apply a certain force to force the insert pin 1 disengaged from the resilient clamping wheels 6 to let the door opened.

However, most of the conventional cabinet doors can only be kept closed but fail to be fully closed fitting to prevent insects from getting in the cabinets.

SUMMARY OF THE INVENTION

One objective of the invention is to offer a cabinet door, able to let a cabinet door pulled inward by the resilient force of a spring and fully closed.

Another objective of the invention is to offer an automatic clasping device for a cabinet door, capable to make the cabinet door closed automatically by touching it with very little force, easy and practical in handling.

One more objective of the invention is to offer an automatic clasping device for a cabinet door, which is simple in structure and economizes producing cost.

BRIEF DESCRIPTION OF DRAWINGS

This invention will be better understood by referring to the accompanying drawings, wherein.

DETAILED OF THE PREFERRED EMBODIMENT

Figure 1:
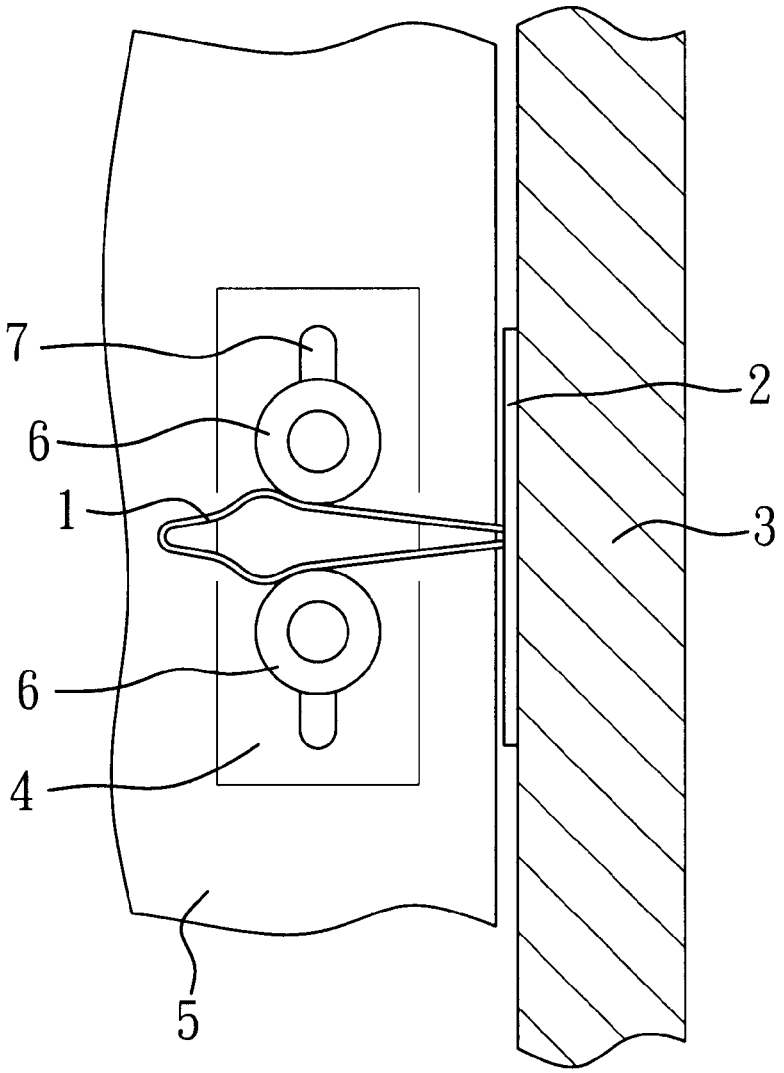
FIG1 PRIOR ART
FIG. 1 is a cross-sectional view of a conventional clasping device for a cabinet door.
Figure 2:
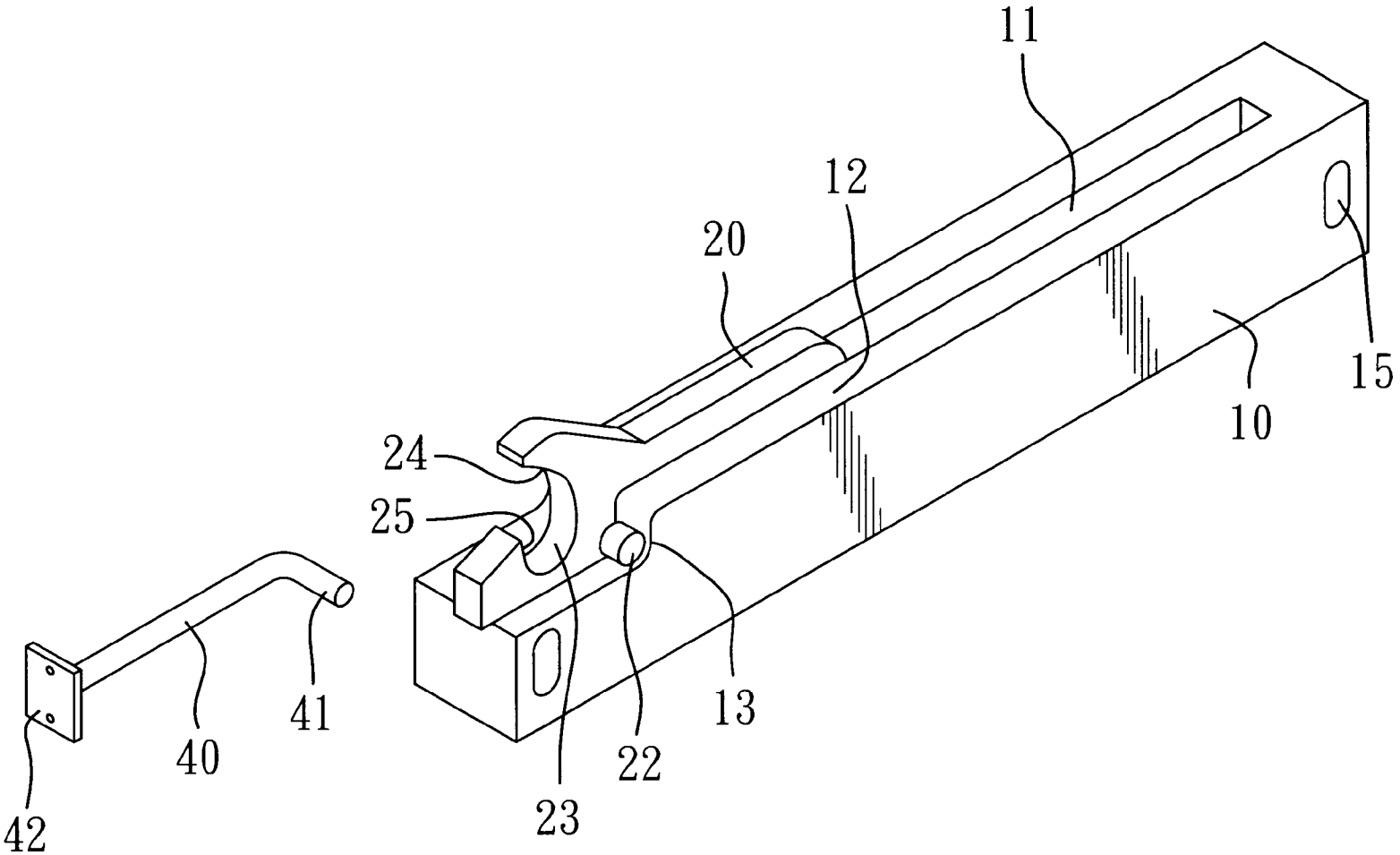
FIG. 2 is a perspective view of an automatic clasping device for a cabinet door in the present invention.
Figure 3:
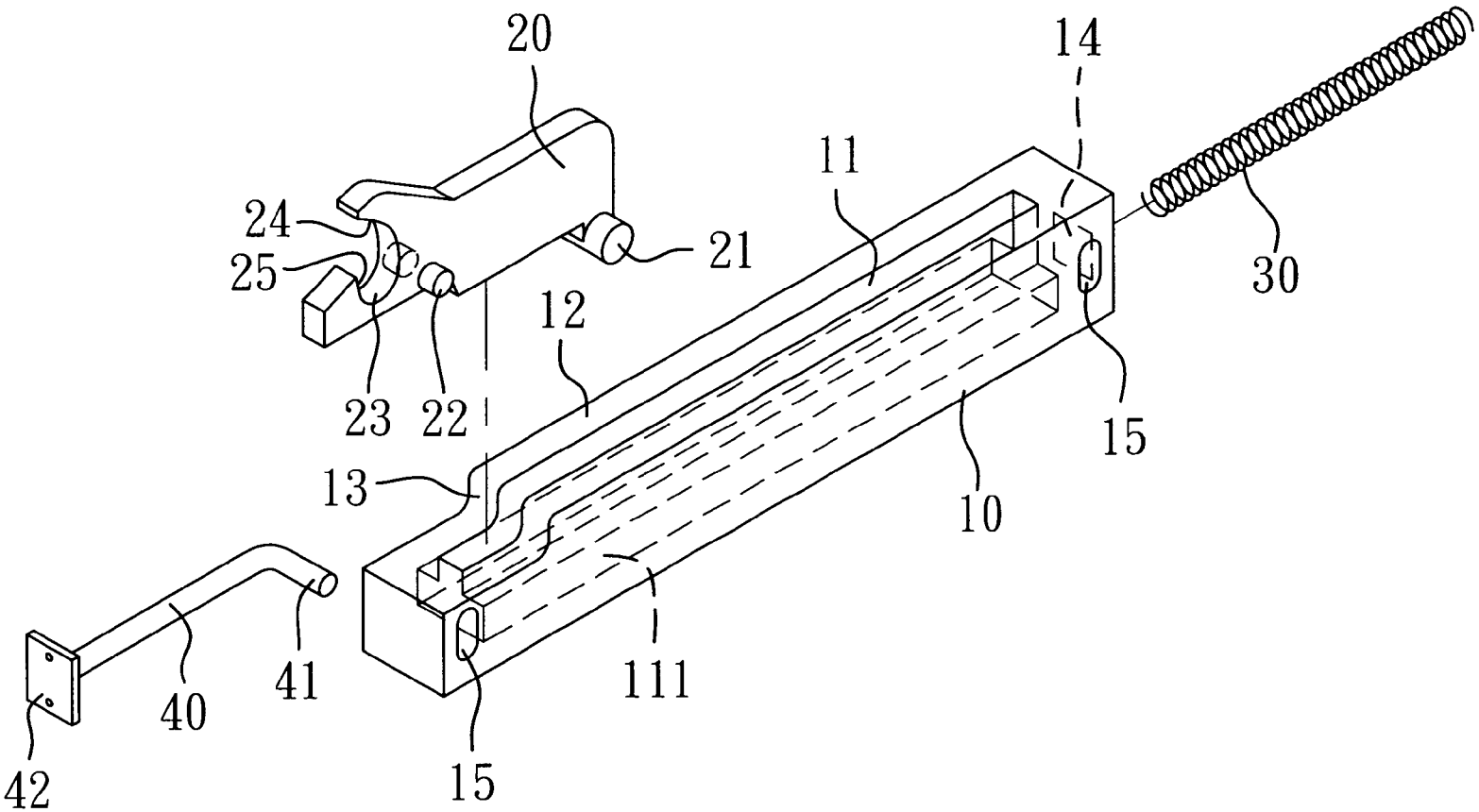
FIG. 3 is an exploded perspective view of the automatic clasping device for a cabinet door in the present invention; and, FIG. 4 and FIG. 5 are cross-sectional views of the automatic clasping device for a cabinet door in operating conditions in the present invention.

A preferred embodiment of an automatic clasping device for a cabinet door in the present invention, as shown in FIGS. 2 and 3, includes a clasp base 10, a clasping member 20, a spring 30, and a hook body 40 as main components combined together.

Figure 5:
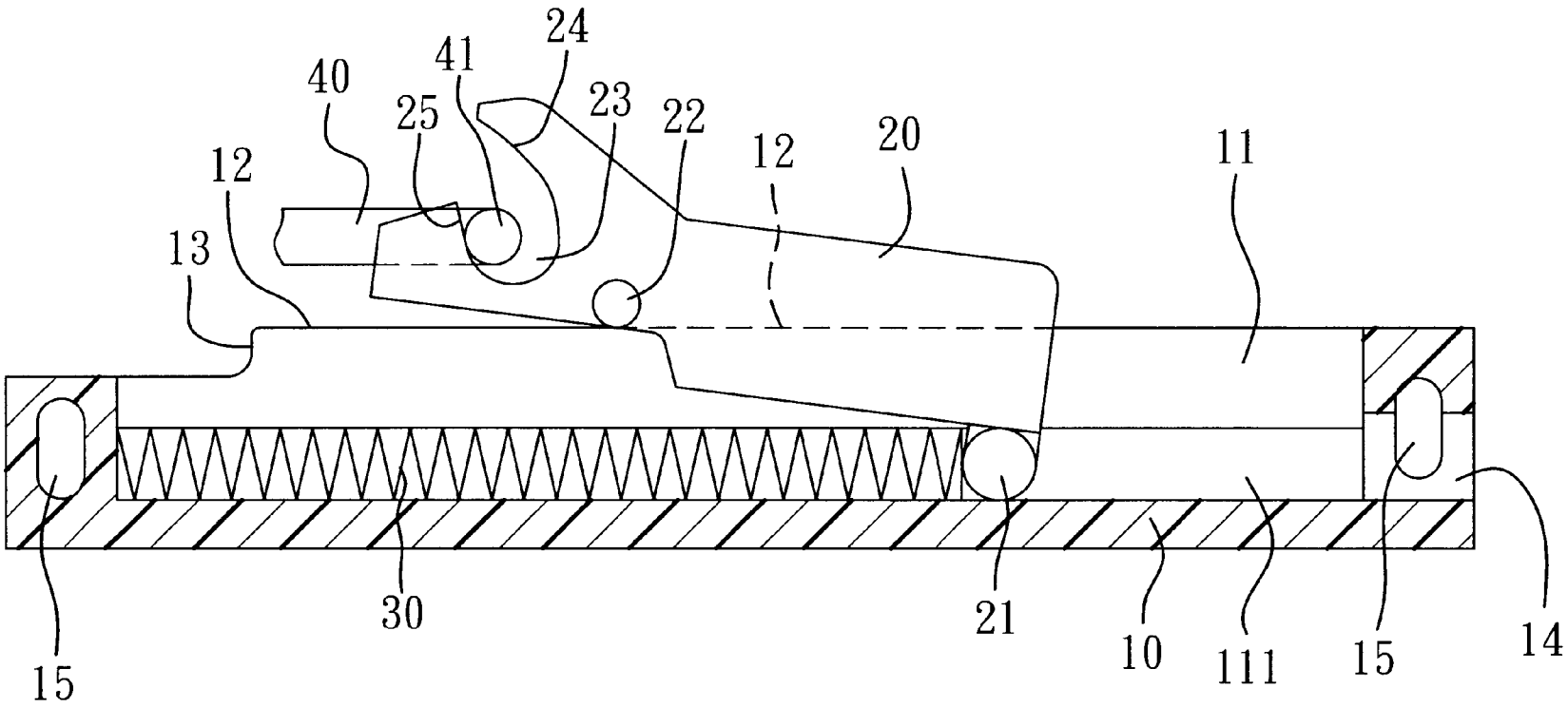

The clasp base 10 is made of plastic, shaped an elongate groove body, and provided lengthwise with a T-like slide groove 11. The T-like slide groove 11 has an inverted T-shaped lateral groove 111 formed at the bottom, and two rails 12 respectively formed on the top sides of opposite side walls, as shown in FIGS. 2 and 5. Besides, the opposite side walls of the slide groove 11 of the front end of the clasp base 10 are in a stepped shape, with the vertical side formed into a stop wall 13. The clasp base 10 further has a through hole 14 bored on the rear wall for a spring 30 to be inserted therethrough, and two fixing holes 15 respectively provided at the front and the rear side for screws to screw and be fixed therein.

Figure 4:
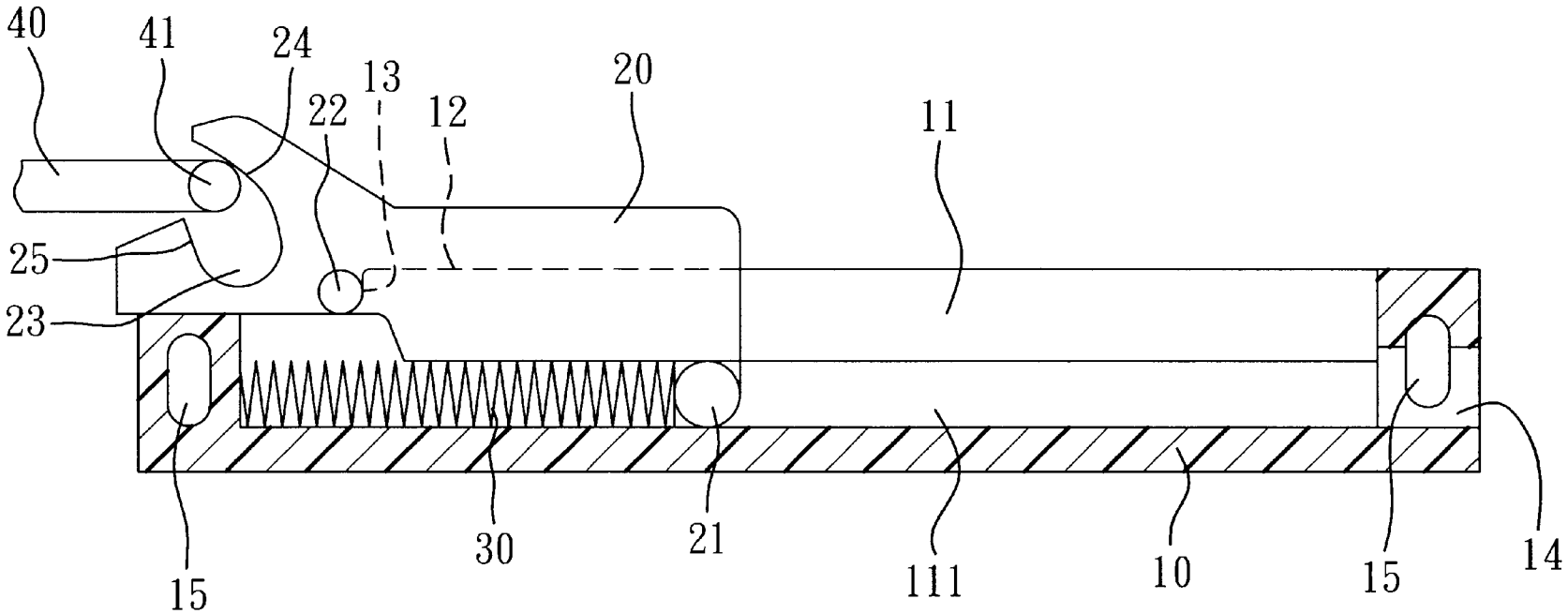

The clasping member 20 is block-shaped and fitted in the T-like slide groove 11 to slide to and from therein. The clasp member 20 has two lateral rods 21 respectively provided vertically on opposite rear bottom sides to be inserted in the lateral grooves 111 of the T-like slide groove 11 so as not to let the clasp member 20 disengaged from the slide groove 11. Moreover, the clasp member 20 has a vertical position limiting rods 22 on opposite sides of the front portion, as shown in FIGS. 2 and 4. Thus, when the clasping member 20 is pulled forward to a preset position, the position limiting rods 22 will slide down to the front position of the clasp base 10 and rest against the stop wall 13 to keep the clasping member 20 positioned in the slide groove 11, as shown in FIGS. 3 and 4. In addition, the clasping member 20 is formed at the front end with a concave portion 23 with an opening facing the front end of the clasp base 10. Then, an upper curved surface 24 facing the front end of the clasp base 10 is formed on the top wall of the concave portion 23, and a hooking member 25 is provided on the opposite side of the upper curved surface 24.

The spring 30 is fitted in between the front wall of the slide groove 11 and the lateral rods 21 of the clasp member 20 for pushing the clasp member 20 backward with its resilient force.

The hook 40 is a L-shaped rod, clasped by the clasping member 20 and make the cabinet door closed. The hook body 40 has one end formed into a curved hook 41, and the other end secured on the door by means of a fixing plate 42.

In assembling, as shown in FIGS. 2 and 4, the spring 30 is first inserted in the lateral groove 111 under the slide groove 11 through the through hole 14. Next, the clasping member 20 is pressed and inserted in the slide groove 11 of the clasp base 10, which is made of plastic and so can be pressed to deform properly with its elasticity for receiving the clasping member 20. At the same time, the lateral rods 21 of the clasping member 20 are respectively fitted in the lateral grooves 111, and the spring 30 has its ends respectively pushing against the front wall of the slide groove 11 and the lateral rods 21, and the position limiting rods 22 are mounted across the rails 12 on opposite sides of the slide groove 11, thus, finishing assembling an automatic clasping device for a cabinet door.

In using, the clasp base 10 is secured on a position of a cabinet body opposite to the other side of the door hinge, and the hook 40 is fixed at a corresponding position of the cabinet door, as shown in FIG. 4. Then, contract the spring 30 and move the clasping member 20 forward to let its position limiting rods 22 slide down and rest against the stop wall 13, and at this time the clasping member 20 is restrictedly positioned at the front portion of the clasp base 10 and its hooking member 25 lies at a relatively low position. Thus, when the cabinet door is closed, the end 41 of the hook 40 of the door will touch the upper curved surface 24 of the clasping member 20 and lift up the front end of the clasping member 20 by the lateral rods 21 serving as a fulcrum. At this time, the position limiting rods 22 is forced to move upward, disengaged from the stop wall 13 and sliding backward along the rails 12, and meanwhile, the hooking surface 25 clasps the end 41 of the hook 40 and the door is pulled by the resilience of the spring 30 to be closed completely with the cabinet body.

On the contrary, when the cabinet door is opened, the clasping member 20 will be pulled forward. And at this time the action of the resilience of the spring 30 and the action of the pulling force of the hook 40 are not on a same level but in parallel, and the lateral rods 21 is restrictedly positioned in the lateral groove 111 as shaft. Therefore, the position limiting rods 22 will be forced by a torsion to move downward and rest against the stop wall 13, and the hooking member 25 will be disengaged from the end 41 of the hook 40 at the same time, letting the clasping member 20 recover its position.

In accordance with the device of this invention described above, a cabinet door can be pulled forward by the resilience of the spring 30 and fully closed fitting with the cabinet body. Besides, the design of the upper curved surface 24 of the clasping member 20 enables the position limiting rods 22 to be disengaged from the stop wall 13 only by closing the door with a little force, easy and convenient in handling.

While the preferred embodiment of the invention has been described above, it will be recognized and understood that various modifications may be made therein and the appended claims are intended to cover all such modifications that may fall within the spirit and scope of the invention.

I claim:

1. An automatic clasping device for a cabinet door comprising:

a clasp base defining an elongate groove body and formed lengthwise with a slide groove, said slide groove having two rails respectively formed on top of opposite side walls, said opposite side walls of said slide groove having front ends formed in a stepped shape and its vertical side formed into a stop wall;

a clasping member including a front end fitted in said slide groove to slide back and forth therein, said clasping member having a position limiting rod vertical to opposite sides formed at the front end, said position limiting rod forced to slide down and rest against the stop wall of said clasp base when said clasping member is pulled forward to a preset position, said clasping member provided at the front end with a concave portion with an opening facing the front side of said clasp base, said concave portion having an upper curved surface formed upward on a top wall and facing the front end of said clasp base, said concave portion further having a bottom wall and a hooking surface on the bottom wall;

a spring fitted between the front wall of said slide groove and said clasping member for pushing said clasping member backward;

a hook body clasped by said hooking surface of said clasping member for closing said cabinet door, said hook body formed with a curved end and secured on said cabinet door by means of a fixing plate;

the hook body including a hook touching said upper curved surface of said clasping member and lifting up the front end of said clasping member when said cabinet door is closed, said position limiting rod disengaged from said stop wall and sliding on said rails, said hooking surface of said clasp member clasping said hook of said hook body to let said cabinet door pull by said spring to the cabinet and be closed fitting together, said clasping member pulled forward to let said position limiting rod slide downward and rest against said stop wall and said clasping member recovering its position when said cabinet door is opened.

2. The automatic clasping device for a cabinet door as claimed in claim 1, wherein said slide groove of said clasp base has an inverted-T lateral groove formed at a bottom side, and said clasping member has two lateral rods vertical to opposite sides at a rear bottom to be inserted in said lateral groove of said slide groove to prevent said clasping member from being disengaged from said slide groove.

* * * * *